US008753000B2

(12) United States Patent
Wu

(10) Patent No.: US 8,753,000 B2
(45) Date of Patent: Jun. 17, 2014

(54) LIGHT HEAD, LIGHT DEVICE USING THE SAME, ASSEMBLING METHOD OF LIGHT HEAD AND LIGHT DEVICE

(75) Inventor: Hsien-Chang Wu, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 198 days.

(21) Appl. No.: 13/540,633

(22) Filed: Jul. 3, 2012

(65) Prior Publication Data

US 2013/0033877 A1 Feb. 7, 2013

(30) Foreign Application Priority Data

Aug. 3, 2011 (TW) ..... 100127575 A

(51) Int. Cl.
*H01R 33/00* (2006.01)
*F21V 19/00* (2006.01)

(52) U.S. Cl.
USPC ..... 362/650; 362/362; 362/382; 362/396

(58) Field of Classification Search
CPC ..... F21K 9/13; F21V 23/06; F21V 19/0005; F21Y 2101/02
USPC ..... 362/362, 382, 396, 650
See application file for complete search history.

(56) References Cited

U.S. PATENT DOCUMENTS 4,975,813 A * 12/1990 Chen ..... 362/650
7,211,955 B2 5/2007 Meguro et al.
2008/0247193 A1* 10/2008 Hsu ..... 362/650
2010/0060408 A1 3/2010 Cheng et al.
2011/0157903 A1* 6/2011 Trewin ..... 362/418
2013/0083548 A1* 4/2013 Wu ..... 362/382

FOREIGN PATENT DOCUMENTS

CN 2324633 Y 6/1999
CN 201465971 U 5/2010
CN 201532924 U 7/2010
WO 2007119923 A1 10/2007

OTHER PUBLICATIONS

"First Office Action of China Counterpart Application", issued on Aug. 1, 2013, p. 1-p. 5.

* cited by examiner

*Primary Examiner* — Stephen F Husar
*Assistant Examiner* — James Cranson, Jr.
(74) *Attorney, Agent, or Firm* — Jianq Chyun IP Office

(57) ABSTRACT

A light head, light device, assembling method of light head and light device are provided. The light device includes a light head and a third unit. The light head includes a first unit, a second unit, a cable, a fixing sheet, a first pin, a conducting sheet, and multiple second pins. The first unit has a side surface, a bottom surface, a pair of slots, and a protrusion portion. The slots are on the bottom surface. The second unit encircling the first unit exposes the protrusion portion. The fixing sheet electrically connected to a first conducting terminal of the cable is inserted into the slots. The first pin inserts into the protrusion portion to make the cable contact the first pin and the protrusion portion. The conducting sheet is under the second unit. The second pins make the conducting sheet, the first and second units assembled together.

25 Claims, 7 Drawing Sheets

LIGHT HEAD, LIGHT DEVICE USING THE SAME, ASSEMBLING METHOD OF LIGHT HEAD AND LIGHT DEVICE

CROSS-REFERENCE TO RELATED APPLICATION

This application claims the priority benefit of Taiwan application serial no. 100127575, filed on Aug. 3, 2011. The entirety of the above-mentioned patent application is hereby incorporated by reference herein and made a part of this specification.

BACKGROUND OF THE INVENTION

1. Field of the Invention

The present invention relates to a light device and an assembling method thereof. More particularly, the present invention relates to a light head with a complete appearance and a light device using the same, and a method of assembling the light head and the light device.

2. Description of Related Art

In the light device and the assembling method of the light device nowadays, the cooperating of cylinder of the light device assembling machine, the pushing member and other components is commonly used, so that the piercing pin can pierce into the light housing and the spiral portion of the light device. And the pierced edge of the spiral portion becomes the internal structure of the light housing to be pierced, so as to fix the light housing and the spiral and effectively improve the fixing effect between the light housing and the spiral portion of the light device. Then, welding process is used to form a welding point on the spiral portion for electrically connection.

However, the inserting method by using the piercing pin piercing the spiral portion would damage the overall appearance of the spiral portion, and the welding point would protrude onto the surface of the spiral portion. Thus, the light device is not in a good appearance and also in an incomplete appearance.

SUMMARY OF THE INVENTION

The present invention provides a light head of a light device having no welding point.

The present invention provides a light device with a complete appearance.

The present invention provides a method of assembling the light head by which the welding process is simplified.

The present invention provides a method of assembling the light device by which the assembling method is rather convenient.

In order to achieve the foregoing or other objects, the invention provides a light head of a light device including a first unit, a second unit, a cable, a fixing sheet, a first pin, a conducting sheet and a plurality of second pins. The first unit has a side surface, a bottom surface, a pair of slots and a protrusion portion, wherein the side surface is connected with the bottom surface. And the slots are disposed on the bottom surface and extend along a direction parallel to the side surface. The second unit is disposed around the first unit, having a first opening, and the first opening exposes the protrusion portion of the first unit. The cable has a first conducting terminal and a second conducting terminal. And the fixing sheet is inserted into the slots and electrically connected to the first conducting terminal of the cable. The first pin is inserted into the protrusion portion correspondingly, wherein the second conducting terminal of the cable is located between the first pin and the protrusion portion, and the second conducting terminal contacts the first pin and the protrusion portion both. The conducting sheet is disposed under the second unit and has a second opening. And the protrusion portion protrudes outside the second opening. The second pins correspondingly pass through the conducting sheet, the first unit and the second unit along an axial direction of the first unit, so that the conducting sheet, the first unit and the second unit are assembled together.

In one embodiment of the light head of the light device of the present invention, the first unit further has a plurality of first riveting holes disposed at the bottom surface and distributed around the protrusion portion. And the second pins correspondingly pass through the first riveting holes.

In one embodiment of the light head of the light device of the present invention, the second unit further has a plurality of second riveting holes, and the second riveting holes are overlapping with the first riveting holes, and the second pins correspondingly pass through the first riveting holes and the second riveting holes.

In one embodiment of the light head of the light device of the present invention, the conducting sheet further has a plurality of third riveting holes. And the third riveting holes are overlapping with the second riveting holes. And the second pins correspondingly pass through the first riveting holes, the second riveting holes and the third riveting holes.

In one embodiment of the light head of the light device of the present invention, the fixing sheet has a main body, a sleeve ring and an assembly part being connected together. The sleeve ring and the assembly part are located on two sides of the main body. The first conducting terminal is embedded into the sleeve ring. And the main body is located in the slots. And the assembly part is formed by bending the main body and so as to extend on the bottom surface of the first unit.

In one embodiment of the light head of the light device of the present invention, one of the second pins further passes through the assembly part.

In one embodiment of the light head of the light device of the present invention, the fixing sheet further has a pair of bending parts located on another opposite sides of the main body different from the sides by which the sleeve ring and the assembly part are located. And the bending parts are wedged within the slots.

In one embodiment of the light head of the light device of the present invention, the first unit further has a pair of locking hooks located at a side of the first unit which is relatively away from the protrusion portion.

In one embodiment of the light head of the light device of the present invention, a shape of the first pin is a tack.

In one embodiment of the light head of the light device of the present invention, each of the second pins has a pillar part and two limiting parts. The limiting parts are distributed at two sides of the pillar part along an axial direction of the pillar part. And the diameters of the limiting parts are larger than the diameter of the pillar part. One of the limiting parts props against the conducting sheet, and another limiting part is located within the first unit.

As embodied and broadly described herein, the present invention further provides a light device including the light head and a third unit disposed on the light head.

In one embodiment of the light head of the present invention, the first unit further has a plurality of first riveting holes disposed at the bottom surface and distributed around the protrusion portion. And the second pins correspondingly pass through the first riveting holes.

In one embodiment of the light head of the present invention, the second unit further has a plurality of second riveting holes, and the second riveting holes are overlapping with the first riveting holes. And the second pins correspondingly pass through the first riveting holes and the second riveting holes.

In one embodiment of the light head of the present invention, the conducting sheet further has a plurality of third riveting holes. And the third riveting holes are overlapping with the second riveting holes. And the second pins correspondingly pass through the first riveting holes, the second riveting holes and the third riveting holes.

In one embodiment of the light head of the present invention, the fixing sheet has a main body, a sleeve ring and an assembly part being connected together. The sleeve ring and the assembly part are located on two sides of the main body. The first conducting terminal is embedded into the sleeve ring. And the main body is located in the slots. And the assembly part is formed by bending the main body and so as to extend on the bottom surface of the first unit.

In one embodiment of the light head of the present invention, one of the second pins further passes through the assembly part.

In one embodiment of the light head of the present invention, the fixing sheet further has a pair of bending parts located on another opposite sides of the main body different from the sides by which the sleeve ring and the assembly part are located. And the bending parts are wedged within the slots.

In one embodiment of the light head of the present invention, the first unit further has a pair of first locking hooks located at a side of the first unit which is relatively away from the protrusion portion. And the third unit has a pair of second locking hooks hooked with the first locking hooks together.

In one embodiment of the light head of the present invention, a shape of the first pin is a tack.

In one embodiment of the light head of the present invention, each of the second pins has a pillar part and two limiting parts. The limiting parts are distributed at two sides of the pillar part along an axial direction of the pillar part. And the diameters of the limiting parts are larger than the diameter of the pillar part. One of the limiting parts props against the conducting sheet, and another limiting part is located within the first unit.

In one embodiment of the light head of the present invention, the third unit is a light housing, a heat sink, a lampshade or an assembly thereof.

As embodied and broadly described herein, the present invention further provides a method of assembling the light head, including the following steps: providing a first unit and a second unit, wherein the second unit is disposed around the first unit; providing a cable, wherein a first conducting terminal of the cable is embedded into a fixing sheet; inserting the fixing sheet into a pair of slots of the first unit, such that the cable is electrically connected to the first unit through the fixing sheet; disposing a second conducting terminal of the cable in a protrusion portion of the first unit; and providing a first pin, and inserting the first pin into the protrusion portion of the first unit so that the second conducting terminal is fixed within the protrusion portion.

In one embodiment of the method of assembling the light head of the present invention, the method further includes the following steps: disposing a conducting sheet under the first unit; providing a plurality of second pins, and inserting the second pins into the first unit from the conducting sheet and passing through the second unit.

As embodied and broadly described herein, the present invention further provides a method of assembling the light head, including the following steps: providing a first unit and a second unit, wherein the second unit disposed around the first unit; providing a cable, wherein a first conducting terminal of the cable is embedded into a fixing sheet; inserting the fixing sheet into a pair of slots of the first unit, such that the cable is electrically connected to the first unit through the fixing sheet; disposing a second conducting terminal of the cable in a protrusion portion of the first unit; providing a first pin, and inserting the first pin into the protrusion portion of the first unit so that the second conducting terminal is fixed within the protrusion portion; disposing a conducting sheet under the first unit; providing a plurality of second pins, and inserting the second pins into the first unit from the conducting sheet and passing through the second unit to assemble a light head; and providing a third unit disposed on the light head to form a light device.

In one embodiment of the method of assembling the light head of the present invention, the method of disposing the third unit on the light head is hooking a plurality of first locking hooks of the first unit and a plurality of second locking hooks of the third unit together.

In light of the above, in the light head, the light device using the light head, the method of assembling the light head and the light device of the present invention, pins are used to achieve the objective of fixing the conducting terminals and obtain a light device with the appearance having no welding point. Thus, the light head and the light device using the light head can have a better appearance. Furthermore, compared with the convention, in the method of assembling the light head and the light device, the step of fixing the conducting terminal with a welding process is not required and the assembling method is simpler.

In order to make the aforementioned and other features and advantages of the invention more comprehensible, embodiments accompanying figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Figure 1:
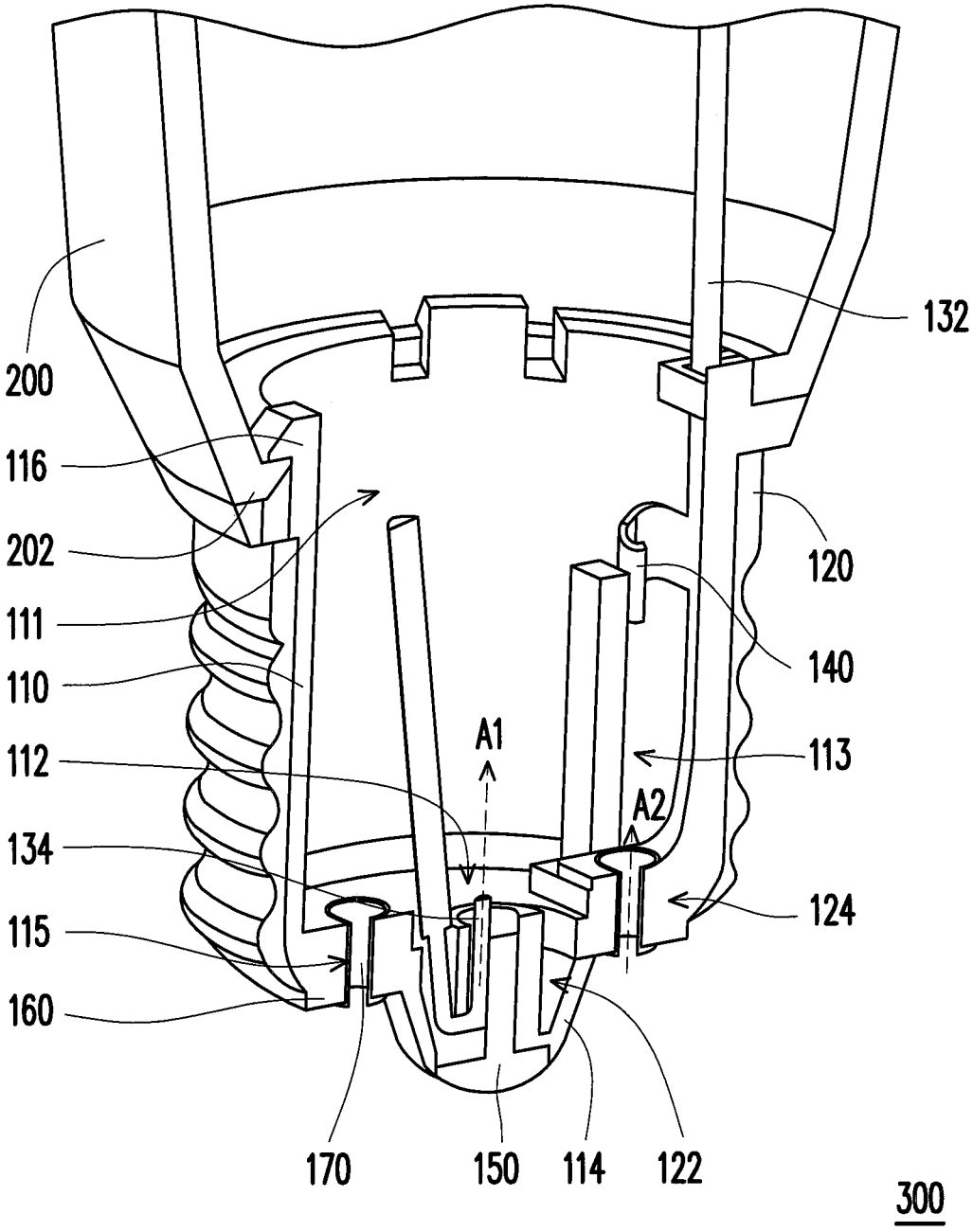
FIG. 1 is a schematic cross-sectional view of a light head according to an embodiment of the present invention.
Figure 2:
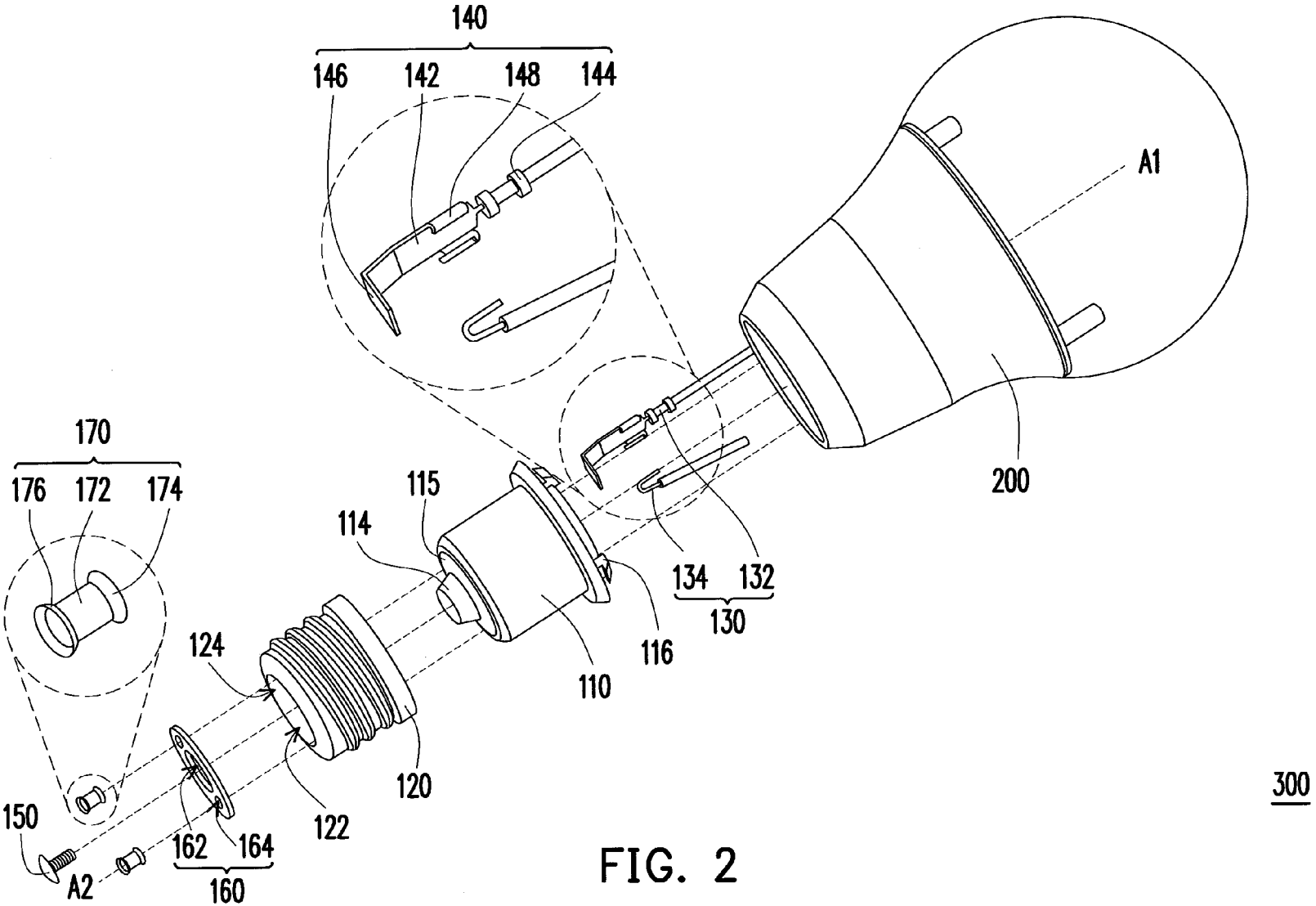
FIG. 2 is an exploded schematic view of the light head in FIG. 1.
Figure 3:
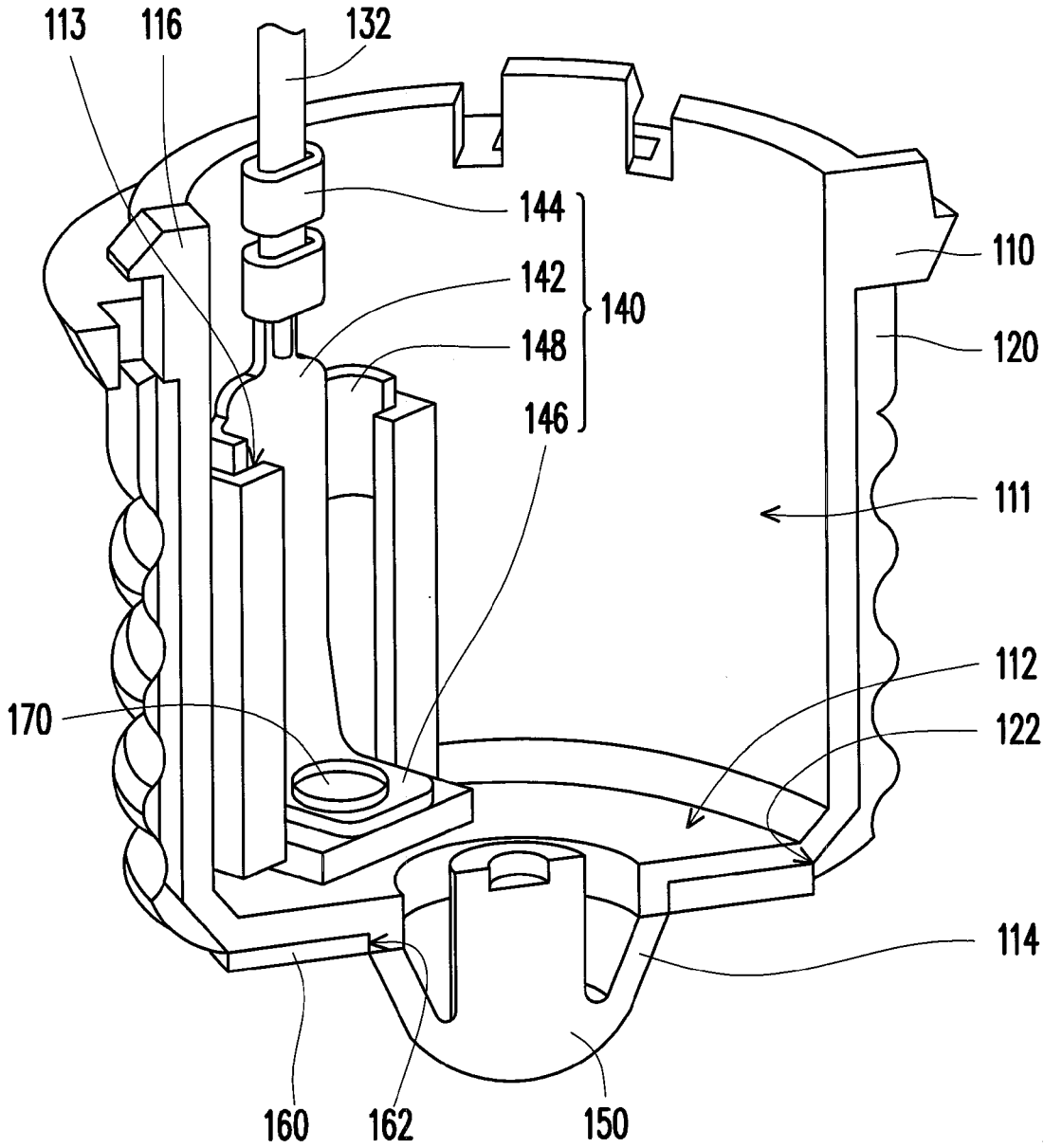
FIG. 3 is a schematic cross-sectional view of the light head in FIG. 1 from another perspective.

FIG. 1 is a schematic cross-sectional view of a light head according to an embodiment of the present invention. FIG. 2 is an exploded schematic view of the light head in FIG. 1. FIG. 3 is a schematic cross-sectional view of the light head in FIG. 1 from another perspective. Referring to FIG. 1, FIG. 2 and FIG. 3 together, the light device 300 includes a light head 100 (shown in FIG. 4E) and a third unit 200 disposed on the light head 100. The light head 100 includes a first unit 110, a second unit 120, a cable 130, a fixing sheet 140, a first pin 150, a conducting sheet 160 and a plurality of second pins 170. The first unit 110 has a side surface 111, a bottom surface 112, a pair of slots 113 and a protrusion portion 114, wherein the side surface 111 is connected with the bottom surface 112. And the slots 113 are disposed on the bottom surface 112 and extend along a direction parallel to the side surface 111. The second unit 120 is disposed around the first unit 110 and has a first opening 122 exposing the protrusion portion 114 of the first unit 110. The cable 130 has a first conducting terminal 132 and a second conducting terminal 134. And the fixing sheet 140 is inserted into the slots 113 and electrically connected to the first conducting terminal 132 of the cable 130. The first pin 150 is inserted into the protrusion portion 114 correspondingly, wherein the second conducting terminal 134 of the cable 130 is located between the first pin 150 and the protrusion portion 114, and the second conducting terminal 134 contacts the first pin 150 and the protrusion portion 114 both. The conducting sheet 160 is disposed under the second unit 120 and has a second opening 162. And the protrusion portion 114 protrudes outside the second opening 162. The second pins 170 correspondingly passes through the conducting sheet 160, the first unit 110 and the second unit 120 along an axial direction A1 of the first unit 110, so that the conducting sheet 160, the first unit 110 and the second unit 120 are assembled together.

The material of the first unit 110 is plastic. The material of the second unit 120 is metal. Herein, the first unit 110 further has a plurality of first riveting holes 115 disposed at the bottom surface 112 and distributed around the protrusion portion 114. And the second pins 170 correspondingly pass through the first riveting holes 115. In addition, the second unit 120 further has a plurality of second riveting holes 124, and the second riveting holes 124 are overlapping with the first riveting holes 115. Correspondingly, the conducting sheet 160 may further have a plurality of third riveting holes 164 overlapping with the first riveting holes 115 and the second riveting holes 124, so that the second pins 170 can conveniently and correspondingly pass through the first riveting holes 115, the second riveting holes 124 and the third riveting holes 164.

As previously mentioned, the fixing sheet 140 has a main body 142, a sleeve ring 144 and an assembly part 146 being connected together. The sleeve ring 144 and the assembly part 146 are located on two sides of the main body 142. The first conducting terminal 132 is embedded into the sleeve ring 144. And the main body 142 is located in the slots 113. And the assembly part 146 is formed by bending the main body 142 and so as to extend on the bottom surface 112 of the first unit 110. Moreover, the fixing sheet 140 further has a pair of bending parts 148 located on another opposite sides of the main body 142 different from the sides by which the sleeve ring 144 and the assembly part 146 are located. And the bending parts 148 are formed by bending the main body 142 along the radial direction of the first unit 110. And the depth of the slots 113 is defined by the radial direction of the first unit 110. Thus, with the dimension matching between the bending parts 148 and the slots 113, the bending parts 148 are wedged within the slots 113, so that the fixing sheet 140 is firmly fixed within the slots 113 in order to avoid the wobble due to the thickness of the main body 142 of the fixing sheet 140 being thinner than the depth of the slots 113, and further makes a better electrical connection between the cable 130 and the first unit 110.

Additionally, the first pin 150 is in a shape of tack so as to conveniently pass through the protrusion portion 114 of the first unit 110. And each of the second pins 170 has a pillar part 172 and two limiting parts 174, 176. Herein the limiting parts 174, 176 are distributed at two sides of the pillar part 172 along an axial direction A2 of the pillar part 172. And the diameters of the limiting parts 174, 176 are larger than the diameter of the pillar part 172, so as to respectively prop against the bottom surface 112 of the first unit 110 and a surface (not shown) of the conducting sheet 160 being away from the second unit 120. More specifically, the limiting part 176 of the present embodiment props against the conducting sheet 160. And the limiting part 174 is located in the first unit 110, while the pillar part 172 passes through the overlapping first riveting holes 115, second riveting holes 124 and third riveting holes 164. Furthermore, in order to fix the fixing sheet 140 within the first unit 110 so that the fixing sheet 140 cannot move along the axial direction A1 of the first unit 110, one of the second pins 170 further passes through the assembly part 146 of the fixing sheet 140. The dimensions of the second pins 170 in the present embodiment can be different according to the total length required to be passed through. In particular, one of the second pins 170 sequentially passes through the first unit 110, the second unit 120 and the conducting sheet 160, and another second pin 170 merely sequentially passes through the conducting sheet 160, the second unit 120, the first unit 110 and the assembly part 146 of the fixing sheet 140. Hence, the lengths of the two second pins 170 are not the same.

In addition, in order to simplify the assembling of the third unit 200 and the first unit 110, the first unit 110 may further have a pair of first locking hooks 116 located at a side of the first unit 110 which is relatively away from the protrusion portion 114. And the third unit 200 correspondingly has a pair of second locking hooks 202 hooked with the first locking hooks 116 together. Both the first locking hooks 116 and the second locking hooks 202 are hooks in the present embodiment. However, in other embodiments, the first locking hooks 116 may be hooks while the second locking hooks 202 are slots or vice versa. In other words, the types of the first locking hooks 116 and the second locking hooks 202 can be correspondingly changed according to the requirement, as long as the first locking hooks 116 and the second locking hooks 202 can be hooked together to firmly fix the third unit 200 onto the first unit 110. The third unit 200 of the present embodiment is a light housing fabricated by plastics.

Figure 4A:
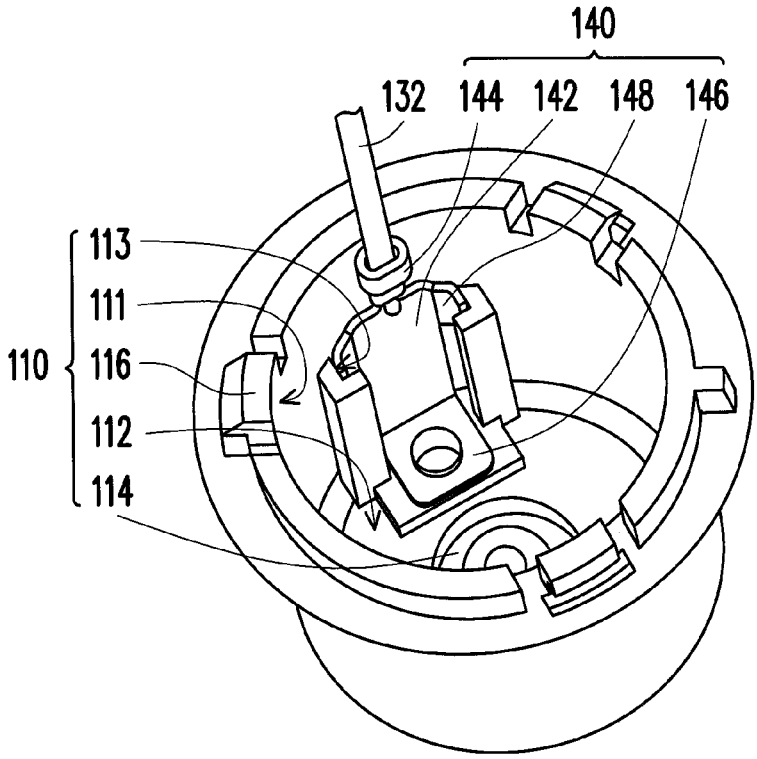
FIG. 4A through 4F is a flowchart of assembling the light head of FIG. 1.
Figure 4B:
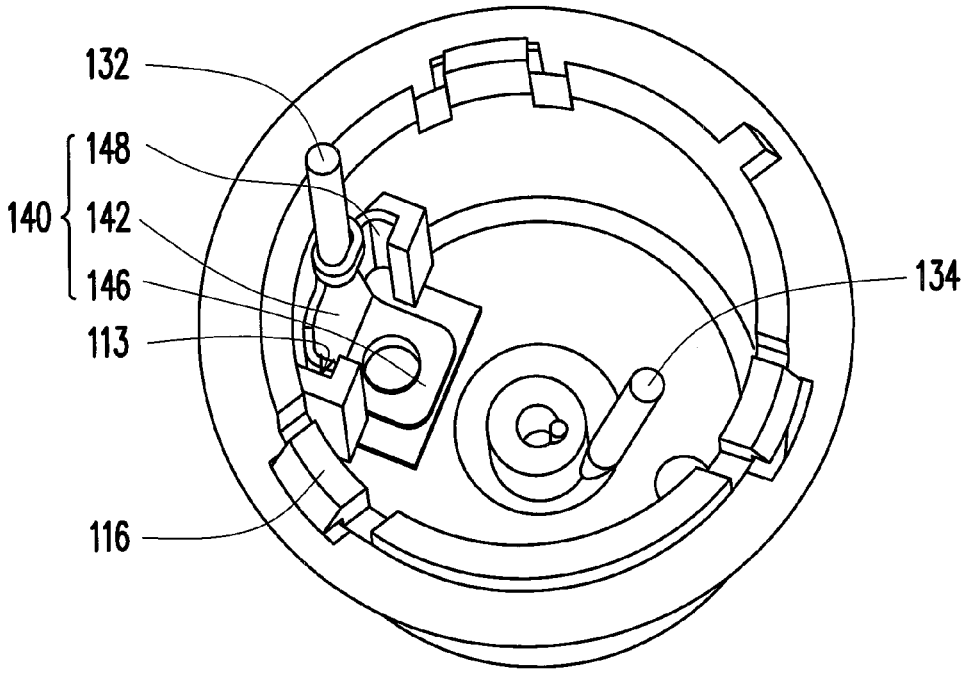
Figure 4C:
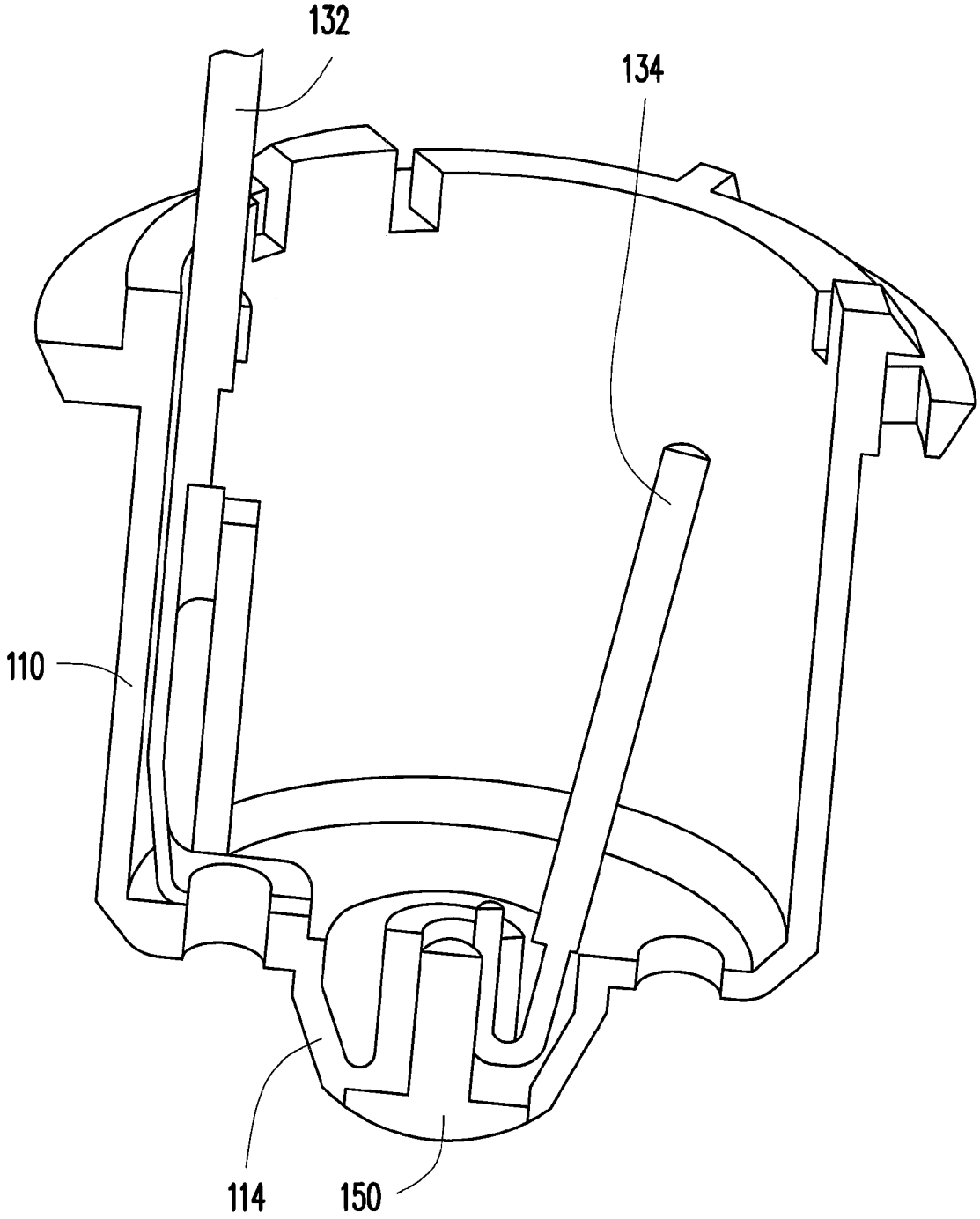
Figure 4D:
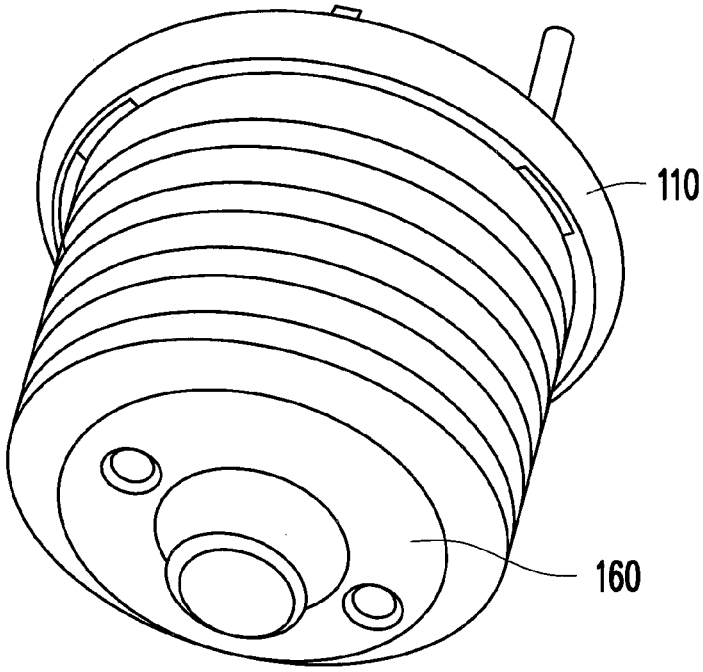
Figure 4E:
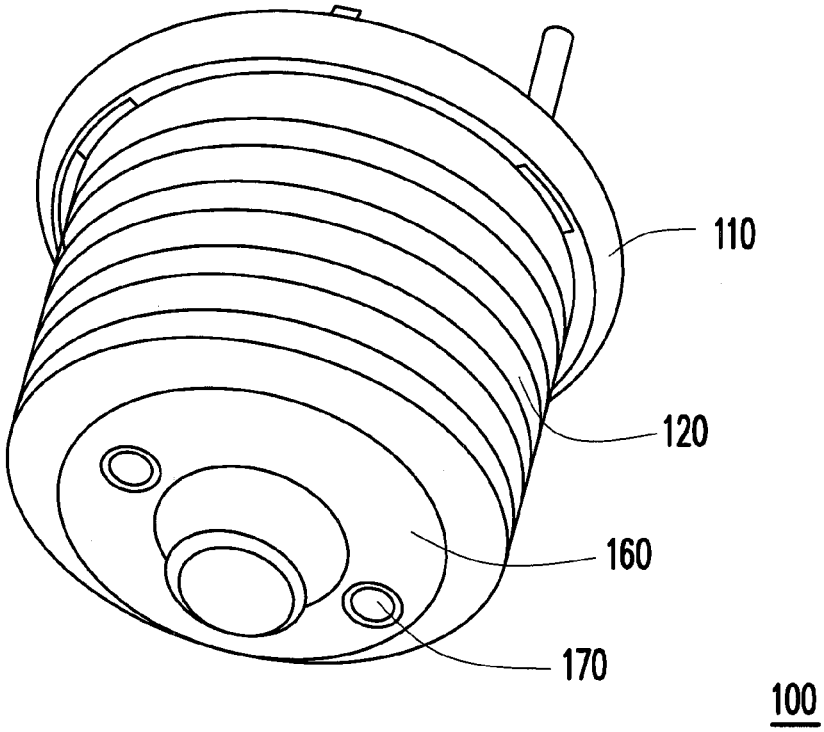

FIG. 4A through 4F is a flowchart of assembling the light head of FIG. 1. The second unit is omitted in FIG. 4A to FIG. 4C to simplify the figures. The method of assembling the light head 100 includes at least the following steps: Referring to FIG. 1, FIG. 2 and FIG. 4A, the first unit 110 and a second unit 120 is provided, wherein the second unit 120 is disposed around the first unit 110. Referring to FIG. 1, FIG. 2 and FIG. 4B together, the cable 130 is provided, wherein the first conducting terminal 132 of the cable 130 is embedded into the fixing sheet 140 and the fixing sheet 140 is embedded into the slots 113 along the axial direction A1 of the first unit 110. Herein, the assembly part 146 of the fixing sheet 140 props against the bottom surface 112 of the first unit 110, the main body 142 of the fixing sheet 140 is located in the slots 113, the bending part 148 of the fixing sheet 140 is inserted into the slots 113 along the radial directional of the first unit 110 so as to fix the main body 142 within the slots 113, and the cable 130 is electrically connected with the first unit 110 through the fixing sheet 140.

Referring to FIG. 1, FIG. 2 and FIG. 4C together, the second conducting terminal 134 of the cable 130 is embedded into the protrusion portion 114 of the first unit 110. And the first pin 150 is inserted into the protrusion portion 114 of the first unit 110, so as to fix the second conducting terminal 134 within the protrusion portion 114 and electrically connect the second conducting terminal 134 with the first unit 110.

Please refer to FIG. 1, FIG. 2 and FIG. 4D. The conducting sheet 160 is disposed under the first unit 110. Please refer to FIG. 1, FIG. 2 and FIG. 4E together. The second pins 170 passes through from the conducting sheet 160 to the second unit 120 and disposed within the first unit 110. Accordingly, the assembling of the light head 100 is approximately completed.

From the method described above, welding process is not used during the whole fabricating process of the light head 100, instead the first conducting terminal 132 of the cable 130 is fixed by using the collocation of the fixing sheet 140 and the first pin 150, and the second pins 170 are used to fix the second conducting terminal 134. Compared with the convention in which the terminal of the cable is fixed to the spiral portion by the welding process and formed an electrical connection point, the light head 100 of the present embodiment has no electrical connection point and thus a better appearance can be obtained. In addition, the method of inserting the pins into the components is rather simpler, safer and more convenient in assembling comparing with the welding process in the prior art.

Figure 4F:
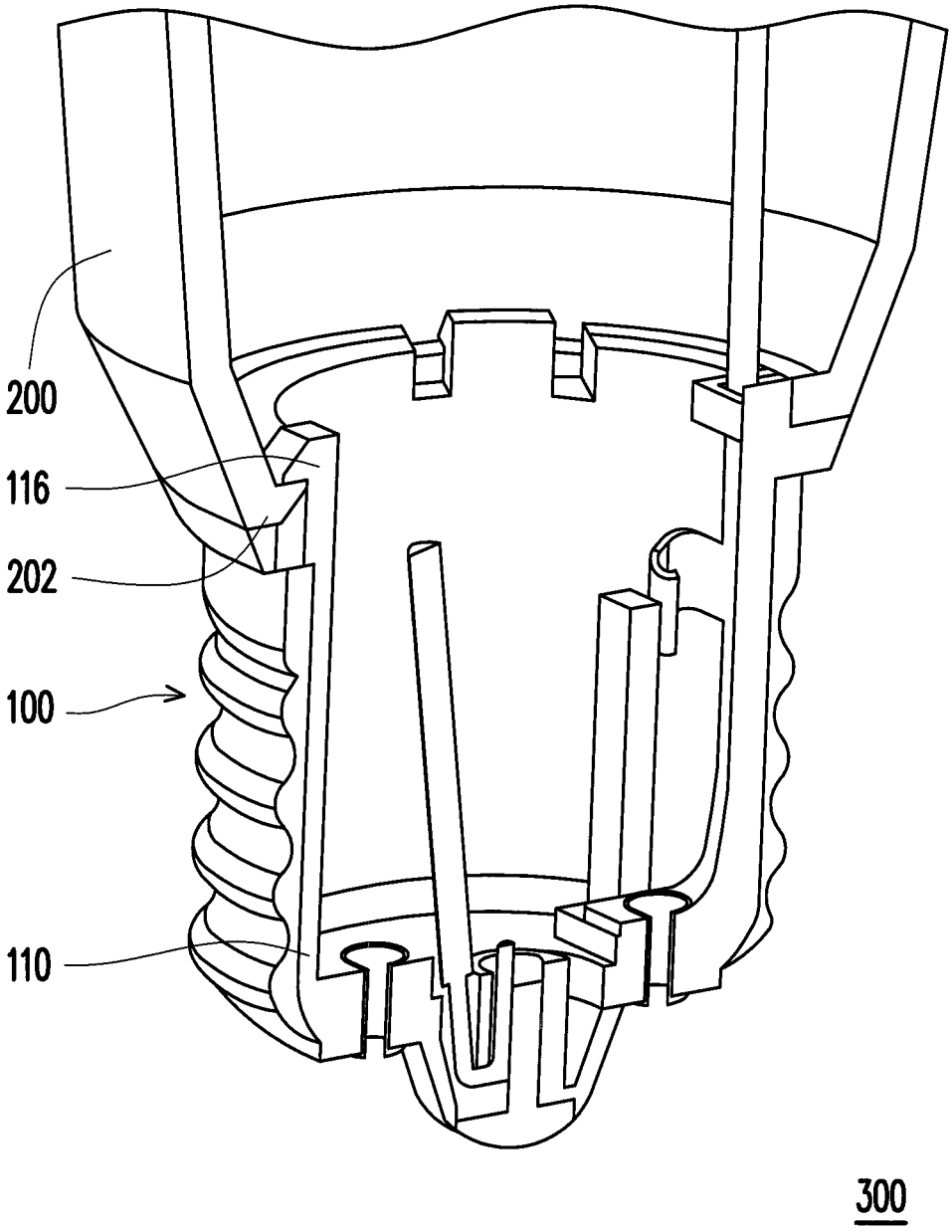

As shown in FIG. 2 and FIG. 4F, the light head 100 is applied in the light device 300. The third unit 200 is disposed on the light head 100 to form the light device 300, wherein the method of the assembling the third unit 200 to the light head 100 is to hook the first locking hooks 116 of the first unit 110 and the second locking hooks 202 of the third unit 200 together. The configuration of the first locking hooks 116 and the second locking hooks 202 facilitates the user to assemble the first unit 110 and the third unit 200 by wedging, and thus the configuration is convenient in assembling.

The third unit 200 of the present embodiment is an assembly of a light housing, a heat sink and a lampshade, wherein the light housing is plastic, the heat sink is metal. The assembling method and the structure of the light housing, heat sink and the lampshade are not the key point of the present invention, and thus the detailed descriptions are not repeated. In other embodiment not shown in the figures, the third unit 200 can also be a light housing, a heat sink, or a lampshade as the requirement. Furthermore, since the light head 100 and the third unit 200 are assembled by the disposition of the first locking hooks 116 and the second locking hooks 202, and thus the user can conveniently change the design of the third unit 200 as required by disposing merely the second locking hooks 202 on the third unit 200. Thus, the light head 100 can be adaptable in various models and designs of the third unit 200.

In light of the foregoing, the light head and the light device using the same, the assembly method thereof of the present invention has at least the following advantages:

1. The welding process of the prior art is replaced by the inserting pins method to fix the two assembly components, thus no welding point would be formed on the assembly components and a complete appearance can be obtained.

2. The welding process of the prior art is replaced by the inserting pins method to fix the conducting terminal with the assembly component, and thus no welding point would be formed on the assembly components and a complete appearance can be obtained.

3. The welding process of the prior art is replaced by the inserting pins method. As for the operators, it is unnecessary to be in a high temperature, and thus it leads to a safer working environment and the assembling process can also be done conveniently.

4. The configuration of the locking hooks facilitates the operators to assemble the assembling components, and thus the configuration is convenient in assembling.

5. The configuration of the locking hooks facilitates the operators to assemble the third unit with various models or designs to the light head, and the effects of resources saving and environmental protection can further be achieved.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A light head of a light device, comprising:

a first unit having a side surface, a bottom surface, a pair of slots and a protrusion portion, wherein the side surface is connected with the bottom surface, and the slots are disposed on the bottom surface and extends along a direction parallel to the side surface;

a second unit disposed around the first unit, having a first opening, the first opening exposing the protrusion portion of the first unit;

a cable having a first conducting terminal and a second conducting terminal;

a fixing sheet inserted into the slots and electrically connected to the first conducting terminal of the cable;

a first pin inserted into the protrusion portion correspondingly, wherein the second conducting terminal of the cable is located between the first pin and the protrusion portion, and the second conducting terminal contacts the first pin and the protrusion portion both;

a conducting sheet disposed under the second unit and having a second opening, and the protrusion portion protruding outside the second opening; and a plurality of second pins along an axial direction of the first unit, correspondingly passing through the conducting sheet, the first unit and the second unit so that the conducting sheet, the first unit and the second unit are assembled together.

2. The light head of the light device as claimed in claim 1, wherein the first unit further has a plurality of first riveting holes disposed at the bottom surface and distributed around the protrusion portion, and the second pins correspondingly pass through the first riveting holes.

3. The light head of the light device as claimed in claim 2, wherein the second unit further has a plurality of second riveting holes, and the second riveting holes are overlapping with the first riveting holes, and the second pins correspondingly pass through the first riveting holes and the second riveting holes.

4. The light head of the light device as claimed in claim 3, wherein the conducting sheet further has a plurality of third riveting holes overlapping with the second riveting holes, and the second pins correspondingly pass through the first riveting holes, the second riveting holes and the third riveting holes.

5. The light head of the light device as claimed in claim 1, wherein the fixing sheet has a main body, a sleeve ring and an assembly part being connected together, the sleeve ring and the assembly part are located on two sides of the main body, the first conducting terminal is embedded into the sleeve ring, and the main body is located in the slots, and the assembly part is formed by bending the main body and so as to extend on the bottom surface of the first unit.

6. The light head of the light device as claimed in claim 5, wherein one of the second pins further passes through the assembly part.

7. The light head of the light device as claimed in claim 5, wherein the fixing sheet further has a pair of bending parts located on another opposite sides of the main body different from sides by which the sleeve ring and the assembly part are located, and the bending parts are wedged within the slots.

8. The light head of the light device as claimed in claim 1, wherein the first unit further has a pair of locking hooks located at a side of the first unit which is relatively away from the protrusion portion.

9. The light head of the light device as claimed in claim 1, wherein a shape of the first pin is a tack.

10. The light head of the light device as claimed in claim 1, wherein each of the second pins has a pillar part and two limiting parts, the limiting parts are distributed at two sides of the pillar part along an axial direction of the pillar part, and the diameters of the limiting parts are larger than the diameter of the pillar part, one of the limiting parts props against the conducting sheet, and another limiting part is located within the first unit.

11. A light device, comprising:

a light head, comprising:

a first unit having a side surface, a bottom surface, a pair of slots and a protrusion portion, wherein the side surface is connected with the bottom surface, and the slots are disposed on the bottom surface and extends along a direction parallel to the side surface;

a second unit disposed around the first unit, having a first opening, the first opening exposing the protrusion portion of the first unit;

a cable having a first conducting terminal and a second conducting terminal;

a fixing sheet inserted into the slots and electrically connected to the first conducting terminal of the cable;

a first pin inserted into the protrusion portion correspondingly, wherein the second conducting terminal of the cable is located between the first pin and the protrusion portion, and the second conducting terminal contacts the first pin and the protrusion portion both;

a conducting sheet disposed under the second unit and having a second opening, and the protrusion portion protruding outside the second opening;

a plurality of second pins along an axial direction of the first unit, correspondingly passing through the conducting sheet, the first unit and the second unit so that the conducting sheet, the first unit and the second unit are assembled together; and a third unit disposed on the light head.

12. The light device as claimed in claim 11, wherein the first unit further has a plurality of first riveting holes disposed at the bottom surface and distributed around the protrusion portion, and the second pins correspondingly pass through the first riveting holes.

13. The light device as claimed in claim 12, wherein the second unit further has a plurality of second riveting holes, and the second riveting holes are overlapping with the first riveting holes, and the second pins correspondingly pass through the first riveting holes and the second riveting holes.

14. The light device as claimed in claim 13, wherein the conducting sheet further has a plurality of third riveting holes overlapping with the second riveting holes, and the second pins correspondingly pass through the first riveting holes, the second riveting holes and the third riveting holes.

15. The light device as claimed in claim 11, wherein the fixing sheet has a main body, a sleeve ring and an assembly part, the sleeve ring and the assembly part are located on two sides of the main body, the first conducting terminal is embedded into the sleeve ring, and the main body is located in the slots, and the assembly part is formed by bending the main body and so as to extend on the bottom surface of the first unit.

16. The light device as claimed in claim 15, wherein one of the second pins further passes through the assembly part.

17. The light device as claimed in claim 15, wherein the fixing sheet further has a pair of bending parts located on another opposite sides of the main body different from sides by which the sleeve ring and the assembly part are located, and the bending parts are wedged within the slots.

18. The light head of the light device as claimed in claim 11, wherein the first unit further has a pair of first locking hooks located at a side of the first unit which is relatively away from the protrusion portion, and the third unit has a pair of second locking hooks hooked with the first locking hooks together.

19. The light device as claimed in claim 11, wherein a shape of the first pin is a tack.

20. The light device as claimed in claim 11, wherein each of the second pins has a pillar part and two limiting parts, the limiting parts are distributed at two sides of the pillar part along an axial direction of the pillar part, and the diameters of the limiting parts are larger than the diameter of the pillar part, one of the limiting parts props against the conducting sheet, and another limiting part is located within the first unit.

21. The light device as claimed in claim 11, wherein the third unit is a light housing, a heat sink, a lampshade or an assembly thereof.

22. A method of assembling a light head, comprising:

providing a first unit and a second unit, wherein the second unit disposed around the first unit;

providing a cable, wherein a first conducting terminal of the cable is embedded into a fixing sheet;

inserting the fixing sheet into a pair of slots of the first unit, electrically connecting the cable and the first unit through the fixing sheet;

disposing a second conducting terminal of the cable in a protrusion portion of the first unit; and providing a first pin, and inserting the first pin into the protrusion portion of the first unit so that the second conducting terminal is fixed within the protrusion portion.

23. The method of assembling the light head as claimed in claim 22, further comprising:

disposing a conducting sheet under the first unit; and providing a plurality of second pins, and inserting the second pins into the first unit from the second unit and passing through the conducting sheet.

24. A method of assembling a light device, comprising:

providing a first unit and a second unit, wherein the second unit disposed around the first unit;

providing a cable, wherein a first conducting terminal of the cable is embedded into a fixing sheet;

inserting the fixing sheet into a pair of slots of the first unit, electrically connecting the fixing sheet and the first unit;

disposing a second conducting terminal of the cable in a protrusion portion of the first unit;

providing a first pin, and inserting the first pin into the protrusion portion of the first unit so that the second conducting terminal is fixed within the protrusion portion;

disposing a conducting sheet under the first unit;

providing a plurality of second pins, and inserting the second pins into the first unit from the conducting sheet and passing through the second unit to assemble a light head; and providing a third unit disposed on the light head to form a light device.

25. The method of assembling the light device as claimed in claim 24, wherein the method of disposing the third unit on the light head is hooking a plurality of first locking hooks of the first unit and a plurality of second locking hooks of the third unit together.

* * * * *